US005962825A

United States Patent [19]

Miller

[11] Patent Number: 5,962,825

[45] Date of Patent: Oct. 5, 1999

[54] UNIVERSAL SENSING EDGE

[75] Inventor: Bearge D. Miller, Concordville, Pa.

[73] Assignee: Miller Edge, Inc., West Grover, Pa.

[21] Appl. No.: 09/094,937

[22] Filed: Jun. 15, 1998

[51] Int. Cl.[6] ..... H01H 3/16

[52] U.S. Cl. ..... 200/61.43; 49/26

[58] Field of Search ..... 49/26–28; 200/61.41–61.44, 200/47, 85 R, 86 R, 86 A, 61.31, 61.73, 61.74, 61.76, 61.62

[56] References Cited

U.S. PATENT DOCUMENTS

| | | | |
|---|---|---|---|
| 3,133,167 | 5/1964 | Miller | 260/61.43 |
| 3,855,733 | 12/1974 | Miller | 49/488 |
| 4,396,814 | 8/1983 | Miller | 200/61.43 |
| 4,785,143 | 11/1988 | Miller | 200/61.43 |
| 4,908,483 | 3/1990 | Miller | 200/61.43 |
| 4,954,673 | 9/1990 | Miller | 200/61.43 |
| 4,972,054 | 11/1990 | Miller et al. | 200/61.43 |
| 5,023,411 | 6/1991 | Miller et al. | 200/61.43 |
| 5,079,417 | 1/1992 | Strand | 250/221 |
| 5,087,799 | 2/1992 | Pariot et al. | 200/61.43 |
| 5,192,837 | 3/1993 | Chardon | 200/61.41 |
| 5,225,640 | 7/1993 | Miller et al. | 200/61.43 |
| 5,260,529 | 11/1993 | Miller | 200/61.43 |
| 5,345,671 | 9/1994 | Miller | 29/622 |
| 5,418,342 | 5/1995 | Miller | 200/61.43 |
| 5,728,984 | 3/1998 | Miller | 200/61.43 |

FOREIGN PATENT DOCUMENTS

| | | | |
|---|---|---|---|
| 1174902 | 9/1984 | Canada | H01H 3/16 |

*Primary Examiner*—Michael Friedhofer

*Attorney, Agent, or Firm*—Akin, Gump, Strauss, Hauer & Feld, L.L.P.

[57] ABSTRACT

A sensing edge for actuating a device to cause a closing door to stop closing upon a force being applied to the sensing edge is provided. The door has a leading edge surface, a first lateral surface, and a second lateral side surface with the first and second lateral side surfaces being oppositely disposed. The sensing edge comprises an elongate sheath positioned adjacent to the leading edge surface of the door and compressible upon application of an external force. The sheath forms a cavity. The sheath has a front side and a back side and first and second oppositely disposed end openings. The front side and back side of the sheath have respective front side and back side apertures extending therethrough. A sensor responsive to an external force applied to the sheath substantially between the first and second openings is positioned within the cavity. A plug is also positioned within the cavity proximate to the first end opening of the sheath. The plug has a first surface facing the cavity, second and third surfaces facing respectively the front and back sides of the sheath and a fourth surface facing the first end opening. The plug has a channel structure extending from the first surface through the plug to the second and third surfaces. At least one electrical conductor is in electrical communication with the sensor for connection with a circuit for controlling the actuation of the door when the sensor detects the application of force to the sheath. The conductor extends through the channel structure from the first surface to one of the second and third surfaces.

18 Claims, 3 Drawing Sheets

UNIVERSAL SENSING EDGE

BACKGROUND OF THE INVENTION

The present invention relates to sensing edges for automatic doors and, more particularly, to bilateral sensing edges which can be readily mounted on either side of the door.

Sensing edges for doors are generally well known. Such sensing edges generally include an elongate sheath in which a force sensing switch (sensor) is positioned. Upon the application of an undesired force to the sheath, the sensor actuates suitable control circuitry for controlling the movement of the door. The sensor, positioned within the sheath, typically comprises a pair of flexible, electrically conductive sheets positioned on the upper and lower sides of a layer of nonconducting foam having a plurality of openings extending therethrough from the upper to the lower side. Upon application of force to the sheath, either or both of the conductive sheets are deflected into electrically conductive engagement with each other through the openings in the layer of foam, to thereby actuate suitable control circuitry for controlling the door.

The typical sensing edge includes conductors attached to the sensor for transmitting the sensing signal to appropriate control circuitry mounted to one side or the other of the door external to the sensing edge. In a typical sensing edge, the conductors exit the sheath of the sensing edge through an aperture that is located either on the end surface of the sheath or on the top edge or side of the sheath.

It is very desirable for the conductors to exit from the inside of the sensor edge in order that the conductors be less susceptible to damage and to avoid interference with the door operation. However, a conventional sensing edge that employs an inside exit for the conductor requires the manufacture of both right hand and left hand versions of the sensing edge in order to properly place the conductors going to the control circuitry located on the inside of the door for both right and left handed door control circuitry installations. An additional problem may arise if an installer goes to the job site and, in the middle of an installation, discovers that for some reason the control circuitry must be located on a different side of the door than was originally planned. He must then leave the job site to exchange the sensing edge that is currently in his possession, for another sensing edge which has the conductors placed on the other side of the sensor edge.

The present invention is directed to a sensing edge for a door for sensing objects that come into contact with the sensing edge during door closing that is compatible with both right hand and left hand door control circuitry installations. The sensing edge in the present invention overcomes the problems inherent in the prior art by providing a means for routing the conductors to either the front side or the back side of the sensing edge after the sensing edge is completely fabricated. Thus a single model of the sensing edge can be used for both left handed and right handed door installations. The result is that only one item need be manufactured for both left and right handed door installations and the installer need only take a single sensing edge to the job site with the assurance that the job requirements can be satisfied even if the installation parameters change during the installation. The ability to route the conductors to either the front side or the back side of the sensing edge makes the sensing edge bilateral.

BRIEF SUMMARY OF THE INVENTION

Briefly stated, the present invention is a sensing edge for actuating a device to cause a closing door to stop closing upon a force being applied to the sensing edge. The door has a leading edge surface, a first lateral side surface, and a second lateral side surface with the first and second lateral side surfaces oppositely disposed. The sensing edge comprises an elongate sheath positioned adjacent to the leading edge surface of the door and compressible upon application of an external force. The sheath forms a cavity. The sheath has a front side and a back side and first and second oppositely disposed end openings. The front side and back side of the sheath have respective front side and back side apertures extending therethrough. A sensor responsive to an external force applied to the sheath substantially between the first and second openings is positioned within the cavity. A plug is also positioned within the cavity proximate to the first end opening of the sheath. The plug has a first surface facing the cavity, second and third surfaces facing respectively the front and back sides of the sheath and a fourth surface facing the first end opening. The plug has a channel structure extending from the first surface through the plug to the second and third surfaces. At least one electrical conductor is in electrical communication with the sensor for connection with a circuit for controlling the actuation of the door when the sensor detects the application of force to the sheath. The conductor extends through the channel structure from the first surface to one of the second and third surfaces.

In another aspect, the present invention comprises a sensing edge for actuating a device to cause a closing door to stop closing upon a force being applied to the sensing edge. The door has a leading edge surface, a first lateral side surface and a second lateral side surface with the first and second lateral side surfaces being oppositely disposed. The sensing edge comprises an elongate sheath positioned adjacent to the leading edge surface of the door and compressible upon application of the external force. The sheath forms a cavity, the sheath having a front side and a back side and first and second oppositely disposed end openings. A sensor is positioned within the cavity. The sensor is responsive to an external force applied to the sheath substantially between the first and second openings. At least one electrical conductor is in electrical communication with the sensor for connection with the circuit for controlling the actuation of the door when the sensor detects the application of force to the sheath. A plug is positioned within the cavity proximate to the first end opening of the sheath. The plug has a first surface facing the cavity, second and third surfaces facing respectively the front and back sides of the sheath and a fourth surface facing the first opening. The conductor is at least integrally molded within the plug.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. The words "right", "left", "upper", and "lower" designate directions to the drawings in which reference is made. The terminology includes the words above specifically mentioned, derivatives thereof and words of similar import.

Figure 1:
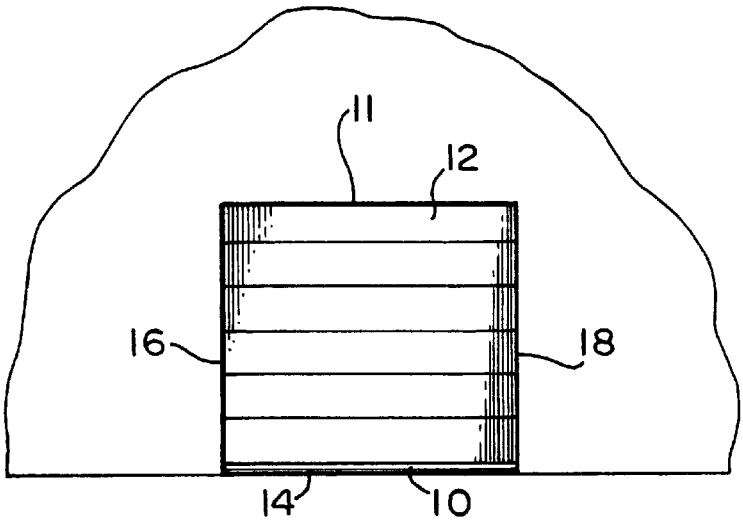
FIG. 1 is a front elevational view showing a door construction including a sensing edge in accordance with the present invention.

Referring to the drawings in detail, wherein like numerals indicate like elements throughout, there is shown in FIGS. 1 through 4 a first preferred embodiment of a sensing edge 10 for actuating a device 47 to cause a closing door 12 to stop closing upon a force being applied to the sensing edge 10, in accordance with the present invention. There is shown in FIG. 1 a doorway 11 provided with the door 12. While the door 12 as illustrated, is an overhead door having a sensing edge 10 in accordance with the present invention along its lower side or leading edge surface 14, it is within the scope and spirit of the invention to incorporate the sensing edge 10 along the edge of any door structure, such as vertically disposed or horizontally moveable doors (not shown) as desired. Moreover, it is understood by those skilled in the art that the sensing edge 10 is not limited to use in connection with only doors, but can be used for other applications, such as automatic windows and gates.

The door 12 has a leading edge surface 14, a first lateral side surface 16 and a second lateral side surface 18. The first lateral side surface 16 and second lateral side surface 18 extend generally parallel with respect to each other, and are oppositely disposed. The door 12 is generally movably mounted on a track (not shown) which guides the door 12 through a range of motion. While the door 12 is indicated to be mounted on a track it is understood by those skilled in the art that other means of mounting the door 12 in a doorway 11 could be employed, including hinges and levers, without departing from the spirit or scope of the invention.

Figure 2:
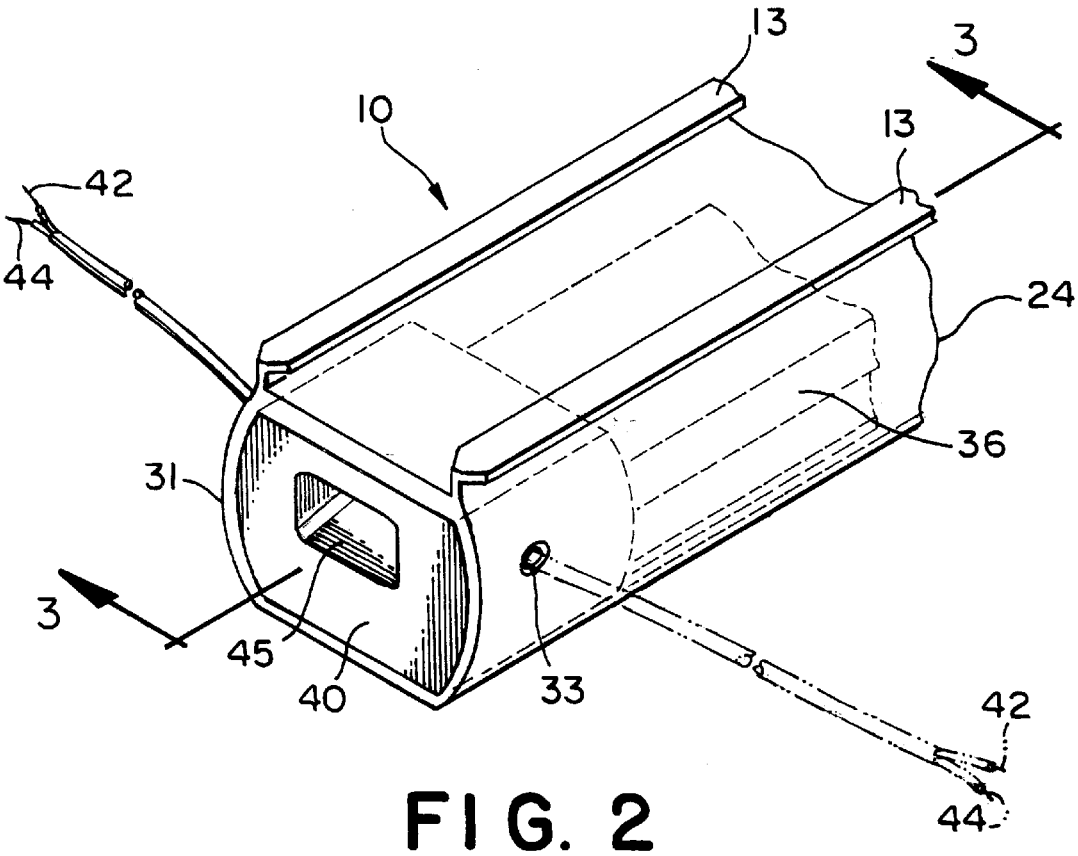
FIG. 2 is an enlarged partial perspective view of a first end of the sensing edge showing the plug and the sensor in phantom.

Referring now to FIG. 2, the sensing edge 10 includes a securing means for fixing or attaching the sensing edge 10 adjacent to the leading edge surface 14 of the door 12. In the embodiment shown, the sensing edge 10 is secured to the door 12 via securing members 13, which extend outwardly from the sensing edge 10 and into suitable complementarily shaped slots in the door 12. Note that the sensing edge 10 may also be secured to the door 12 in any other suitable manner. For instance, the sensing edge 10 may be secured by a single member which extends outwardly from the sensing edge 10 and into a suitably sized groove in the leading edge of the door 14 and secured in the groove by use of a friction fit, adhesive substance or any other conventional securing means (not shown). Moreover, it is also within the spirit and scope of the invention to secure the sensing edge 10 to the leading edge surface 14 of the door 12 by an adhesive (not shown) applied between the leading edge surface 14 and the peripheral face of the sensing edge 10.

Figure 3:
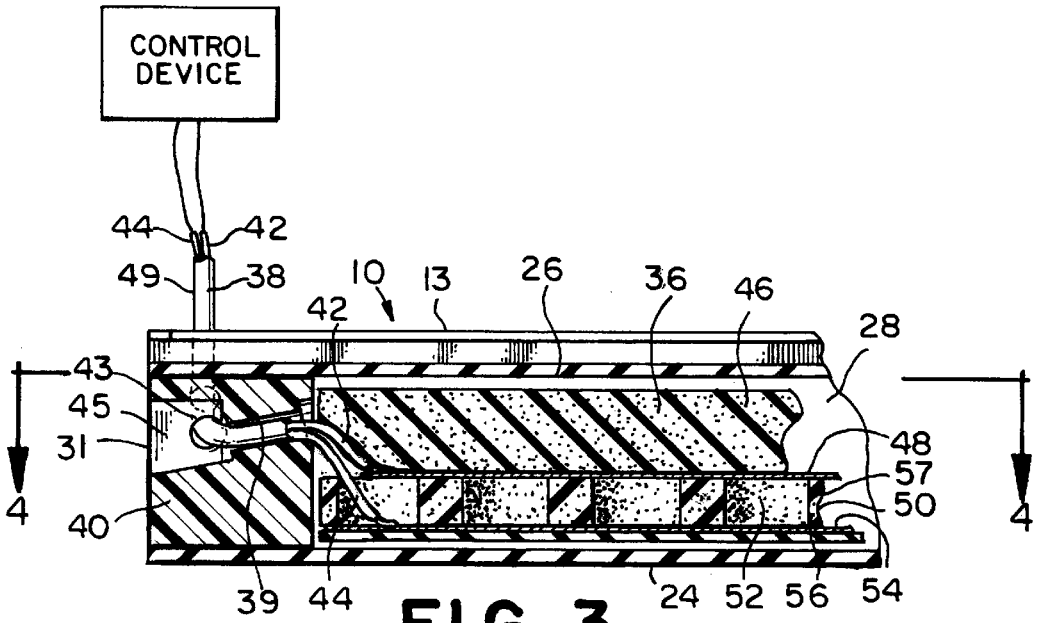
FIG. 3 is a partial cross-sectional elevation view of the sensing edge shown in FIG. 2 taken along line 3—3 of FIG. 2.
Figure 4:
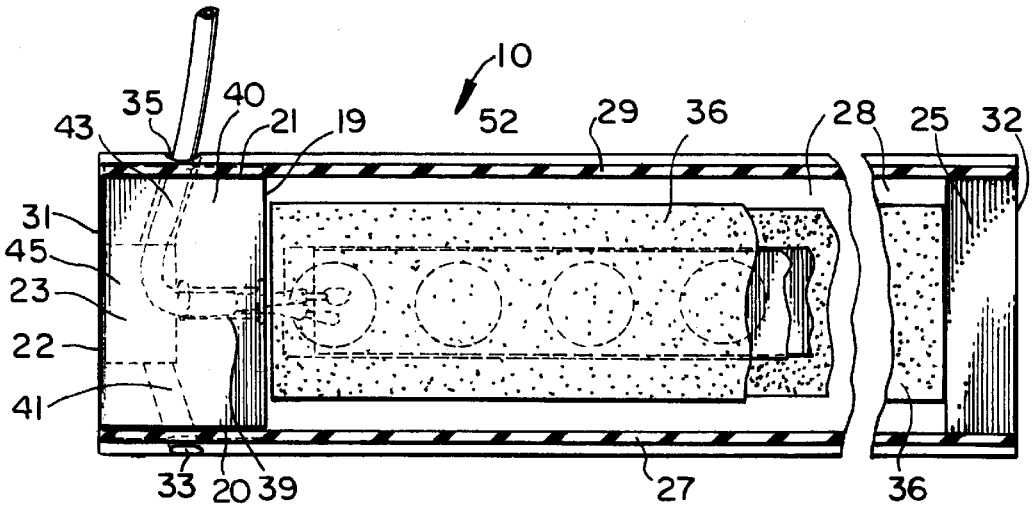
FIG. 4 is a partial cross-sectional plan view of the sensing edge shown in FIG. 3 taken along line 4—4 of FIG. 3.

Referring now to FIGS. 3 and 4, the sensing edge 10 is comprised of an elongate sheath 24, forming a cavity 28, which is compressible upon application of an external force. In the present embodiment, it is preferred that the sheath 24 be advantageously fabricated of a form-retaining, but flexible material, such as rubber. However, it is understood by those skilled in the art, that the sheath can be made of any form-retaining, flexible material, such as elastomeric material. It is preferred that the sheath 24 have a generally constant cross-sectional outline, extending closely along the leading edge surface 14 of the door 12. In the present embodiment, the sheath 24 is of generally of circular cross-section having the bottom and top cut off to form flat surfaces, but may be of any other suitable shape, such as rectangular or semi-circular (not shown).

Referring now to FIG. 4, the sheath 24 has a first end opening 31 and a second oppositely disposed end opening 32, a front side 27 with a front side aperture 33 and a back side 29 with a back side aperture 35. The sensing edge 10 is secured to the leading edge surface 14 of the door 12 such that the first end opening 30 and the first side surface 16 of the door 12 are generally coplanar and the second end opening 32 and the second side surface 18 of the door 12 are also generally coplanar.

Referring now to FIGS. 3 and 4, a sensor 36 is positioned within the cavity 28. The sensor 36 is responsive to an external force applied to the sheath 24 substantially between the first and second openings 31, 32. In the first preferred embodiment, the sensor 36 runs substantially the entire length of the sensing edge 10. More particularly, the sensor 36 comprises a first sheet of resiliently compressible material 46 which is positioned within the sheath 24 and includes a first face and a second face. The first face of the first sheet of resiliently compressible material 46 is in engagement or corresponding facing relationship with the top side 26 of the sheath 24. In the first preferred embodiment, the first sheet of resiliently compressible material 46 and succeeding layers and sheets, described hereinafter, are generally sized to complement the internal configuration of the sheath 24. However, it is understood by those skilled in the art, that the first sheet of resiliently compressible material 46 and succeeding layers can be sized as wide or as narrow as desired, and be virtually of any length for accommodating different structures and uses.

In the first preferred embodiment the first sheet of resiliently compressible material 46 is constructed of generally soft foam rubber. However, it is understood by those skilled in the art, that the first sheet of resiliently compressible material 46 can be constructed of either closed or open cell foam rubber or of other materials having similar properties.

Just below (when viewing FIG. 3) the first sheet of resiliently compressible material 46 is a first sheet of flexible, electrically conductive material 48, engaged therewith, having a first and a second face. The first face of the first sheet of flexible, electrically conductive material 48 is in engagement or in corresponding facing relationship with the second face of the first sheet of resiliently compressible material 46.

In the first preferred embodiment, the first sheet of flexible, electrically conductive material 48, is generally thin and preferably constructed of aluminum or aluminum foil. However, it is within the spirit and scope of the invention, to construct the first sheet of flexible, electrically conductive material 48 of other materials, such as copper or brass.

The first sheet of flexible, electrically conductive material 48 is in engagement with a layer of non-conductive material 50 having a first face and a second face for spacing apart the first sheet of flexible electrically conductive material 48 and a second sheet of flexible, electrically conductive material 54, described hereinafter. The first face of the layer of non-conductive material 50 is in engagement or corresponding facing relationship with the second face of the first sheet of flexible, electrically conductive material 48.

The layer of non-conductive material 50 has at least one opening 52 extending therethrough between the first and second faces thereof. As shown in FIGS. 3 and 4, the layer of non-conductive material 50 preferably includes a plurality of spaced openings 52 interspersed along the entire length thereof for allowing the actuation of the sensor 36 by applying pressure thereto and causing the electrically conductive material 48, 54 to make contact. In the present embodiment, it is preferred that the openings 52 be generally oval-shaped in cross-section. However, it is in the spirit and scope of the invention to configure the openings 52 of any geometric shape, such as square or circular.

The layer of non-conductive material 50 is preferably constructed of generally soft foam rubber. It is understood by those skilled in the art, that the layer of non-conductive material 50 can be constructed of either closed or open cell foam or other materials having similar properties so long as the function of the sensor 36 is achieved.

The layer of non-conductive material 50 is in engagement with a second sheet of flexible, electrically conductive material 54 having a first face and a second face. The first face of the second sheet of flexible, electrically conductive material 54 is in engagement or in corresponding facing relationship with the second face of the layer of non-conductive material 50.

In the present embodiment, it is preferred that the second sheet of flexible, electrically conductive material 54 be constructed of the same material and configuration as the first sheet of flexible, electrically conductive material 48.

In engagement with the second sheet of flexible, electrically conductive material 54 is a second sheet of resiliently compressible material 56 having a first face and a second face. The first face of the second sheet of resiliently compressible material 56 is in engagement or corresponding facing relationship with the second face of the second sheet of flexible, electrically conductive material 54. The second sheet of resiliently compressible material 56 is preferably constructed of the same material and configured generally identically to the first sheet of resiliently compressible material 46, except that it has a lesser thickness. However, it is apparent to those skilled in the art, that the first and second sheets of resiliently compressible material 46, 56 can differ in configuration, size and/or material.

Referring to FIGS. 3 and 4, at least one electrical conductor 38 is in electrical communication with the sensor 36 for connection with a circuit (not shown) that forms part of a control device 47 for controlling the actuation of the door 12 when the sensor 36 detects the application of force to the sheath 24. Such control devices 47 are well known to those of ordinary skill in the art, accordingly further description thereof is omitted for purposes of brevity and convenience only and is not limiting. In the first preferred embodiment, the electrical conductor 38 is comprised of first and second electrical conductors or wire 42, 44 encapsulated in a casing 49 and electrically connected to the first and second sheets 48, 54 of the sensor 36, respectively, preferably by soldering at one end thereof. However, it is understood that the first and second electrical conductors 42, 44 can be connected to the first and second sheets 48, 54 by any suitable means, such as welding or crimping.

In the first preferred embodiment, shown in FIGS. 3 and 4, a plug 40 is positioned within the cavity 28 proximate to the first end opening 31 of the sheath 24. The plug 40 sealingly engages the internal surface of the sheath 24 to provide a fluid impervious barrier so that the sensor 36 is protected from outside elements such as air, water, and other liquid or solid material. The plug 40 has a first surface 19 facing the cavity 28, second and third surfaces 20, 21 facing respectively the front and back sides 27, 29 of the sheath 24 and a fourth surface 22 facing the first end opening 31 of the sheath 24. The plug 40 includes a channel structure 23 extending from the first surface 19 through the plug 40 to the second 20 and third 21 surfaces.

In the first preferred embodiment it is preferred that the channel structure comprises first, second, and third channels 39, 41 and 43 extending from the first, second and third surfaces 19, 20 and 21 of the plug 40 into the plug 40, respectively. The first channel 39 is in communication with the second 41 and third 43 channels. A fourth channel 45 having a cross sectional area which permits a conductor located within the fourth channel 45 to be recessed below the fourth surface 22 extends from the fourth surface 22, to the first channel 39. The second and third channels 41, 43 are aligned with the front side and back side apertures 33, 35 of the sheath 24 when the plug 40 is positioned within the sheath 24.

In the first preferred embodiment, the conductor 38 extends through the channel structure 23 from the first surface 19 to one of the second and third surfaces 20, 21. It is preferred that the conductor 38 extends through the first and fourth channels 39, 45 and subsequently is routed through one of the second 41 or third 43 channels. By virtue of the second and third channels 41, 43 being aligned with the front and back side apertures 33, 35 of the sheath 24 the conductor 38 may be chosen to exit the sheath 24 from either the front side of the sheath 27 or the back side of the sheath 29. Therefore, the sensing edge 10 may be installed on a door 12 with the plug 40 proximate to either of the first or second side surfaces of the door 16, 18, thereby making the sensing edge 10 bilateral.

In the preferred embodiment, a stopping block 25, sealingly engaging the sheath, is positioned proximate to the second end opening of the sheath 32. The stopping block 25, in combination with the plug 40, prevents the weight of the door 12 from activating the sensor 36 when the door makes contact with an intended surface such as the ground or a door frame (not shown). In order not to interfere with the operation of the sensor 36, the plug 40 and the stopping block 25 are positioned within the sheath 24 such that they remain outside the sensing range of the sensor 36. It is generally preferred that the plug 40 and the stopping block 25 be constructed of polyvinyl chloride (PVC). However, it is appreciated by those skilled in the art that the plug 40 and the stopping block 25 may be constructed of any substantially non-compressible substance, such as hardened rubber, stiffened plastic, or synthetic resin.

In accordance with the first preferred embodiment, the sensing edge 10 may be manufactured for any particular installation with or without knowledge of which side of the door 12 the control device 47 will be mounted. Assuming no knowledge of which side of the door 12 the control device 47 will be mounted the manufacturing assembly steps would comprise: (1) threading one end the conductor 38 through the first and fourth channels 39, 45 of the plug 40; (2) cutting the sheath 24 and the sensor 36 to length depending upon the specific door 12 dimensions; (3) stripping the conductor wires 42, 44 of the conductor 38 and attaching the wires 42, 44 to the first and second sheets of electrical conductors 48, 54 of the sensor 36; (4) inserting the stopping block 25 into the sheath 24 and sealing the stopping block 25 to the sheath 24; (5) inserting the sensor 36 and plug 40 into the sheath 24; and (6) sealing the plug 40 to the sheath 24. At this point in the assembly of the sensing edge 10, the conductor 38 extends out from the fourth surface 22 of the plug 40 and sensing edge 10 is ready for installation.

Completion of the sensing edge 10 assembly is performed following attachment to the door 12, at which time the conductor 38 is threaded through one of the second or third channels 41, 43 depending on whether the control device 47 is on the left or the right hand side of the door 12. Following the threading of the conductor 38 through the second or third channels 41, 43, the fourth channel 45 and the front and back side apertures 33, 35 are sealed with caulking compound (not shown) to prevent the entrance of moisture into the sensing edge 10. The conductor 38 is then electrically connected to the control device 47.

Assuming the sensing edge 10 is manufactured with knowledge of which side of the door 12 the control device 47 will be mounted, then the threading and sealing steps described in the preceding paragraph can be carried out at the manufacturing site instead of the installation site.

Figure 5:
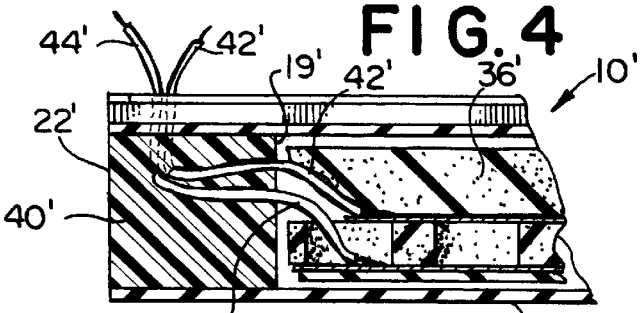
FIG. 5 is a partial cross-sectional elevation view similar to FIG. 3 showing a sensing edge in accordance with a second embodiment of the present invention.
Figure 6:
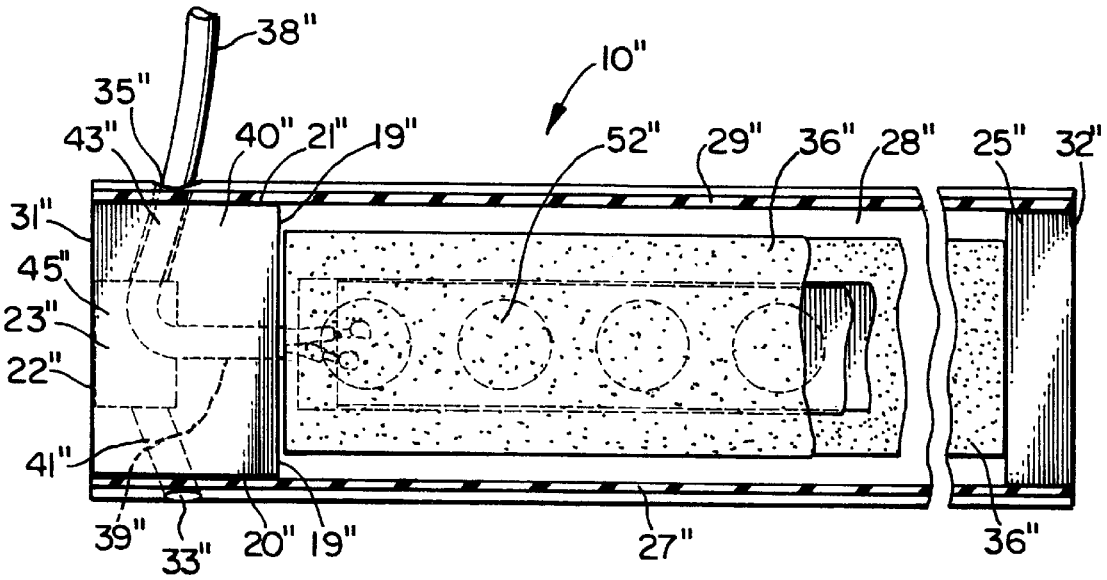
FIG. 6 is a partial cross-sectional plan view similar to FIG. 4 showing a sensing edge in accordance with a third embodiment of the present invention.

There is shown second and third preferred embodiments in FIGS. 5 and 6 respectively. The second and third preferred embodiments are similar to the first preferred embodiment, and as such, like element numerals are used for both the first, second and third embodiments except the numerals for the second and third embodiments have been further given the prime and double prime designations respectively. For purposes of brevity and convenience, only those portions of the second and third embodiments which are different from the first embodiment are described hereinafter. The second and third embodiments employ a molded plug 40', 40" resulting in additional sealing of the cavity 28 from the environment by eliminating the first channel 39 from the plug 40 and consequently, the potential for leakage around the conductor 38.

Referring now to FIG. 5, the second preferred embodiment comprises a plug 40' in which the conductor 38' is integrally molded within the plug 40'. It is preferred, in the second embodiment that the molded conductor 38' extends generally from the first surface 19' of the plug 40' to either the second, third or fourth surfaces 20', 21', 22' of the plug. Accordingly, the selection of a specific plug 40' with the conductor 38' molded to exit from one of the second, third or fourth surfaces 20', 21', 22' is determined by the location of the control device 47 in a particular door 12 installation. Aside from the channel through which the conductor 38' passes, there are no other channels in the plug 40' made in accordance with the second preferred embodiment.

The manufacture of the second preferred embodiment is similar to that of the first embodiment, except that knowledge of the location of the control device 47 is preferred. Accordingly, the manufacturing assembly steps would comprise: (1) selecting a specific right or left hand plug 40' and cable 38' suitable for the respective right or left hand installation needed; (2) cutting the sheath 24' and the sensor 36' to length depending upon the specific door 12 dimensions; (3) stripping the conductor wires 42', 44' of the conductor 38' and attaching the wires 42', 44' to the first and second sheets of electrical conductors 48', 54' of the sensor 36'; (4) inserting the stopping block 25' into the sheath 24' and sealing the stopping block 25' to the sheath 24'; (5) inserting the sensor 36' into the sheath 24' (6) threading the cable 38' through one of the front or back side apertures 33', 35'; (7) inserting the plug 40' into the sheath 24'; (8) sealing the plug 40' to the sheath 24'; and (9) sealing the fourth channel 45' and the front and back side of apertures 33', 35' with a caulking compound. At this point in the assembly of the sensing edge 10', the conductor 38' extends out from one of the plug's 40' second, third or fourth surfaces 20', 21', 22' and the sensing edge 10' is ready for installation.

Referring now to FIG. 6, a third preferred embodiment is shown having a plug 40", the plug 40" having within it second and third channels 41", 43" extending from the second and third surfaces 20", 21" into the plug 40" and a fourth channel 45" on the fourth surface 22". In the third preferred embodiment, the molded conductor 38" extends from the first surface 19" of the plug 40" to the fourth surface 22" of the plug 40" and is recessed within the fourth channel 45" and further extends through either the second or third channel 41", 43", thereby allowing the plug 40" to be positioned proximate to either of the first or second side surfaces 16, 18 of the door 12 such that the sensing edge 10' is bilateral. The third embodiment combines features from the first and second embodiments in that the plug 40" and cable 38" are molded together in the area of the first channel 39", but the installer of the sensing edge 10" still has the option of right or left hand installation by threading the cable 38" through one of the second or third channels 41" or 43". In the case of the third embodiment, the manufacture of the sensing edge 10" is identical to the first embodiment except that the first step of threading the cable 38" through the plug 40" need not be done since the cable 38" is already molded in the plug 40". The installation procedure for the third embodiment is identical to that of the first embodiment.

The order in which the foregoing steps of assembly of the sensing edge 10 in accordance with the first, second and third embodiments is not pertinent to the present invention. That is, it is understood by those of ordinary skill in the art from this disclosure that the order of the steps of assembly can be varied without departing from the spirit and scope of the invention. For instance, selecting and cutting the length of the sheath 24 and sensor 36 could be the first step in the assembly process.

From the foregoing description, it can be seen that the present invention comprises a sensing edge 10 for causing a closing door 12 to open by actuating a device upon force being applied to the sensing edge 10. The sensing edge 10 of the present invention overcomes the problems inherent in the prior art by first, providing an increased sensing area due to the placement of the conductors 42, 44 at an end opening 30 of the sheath 24, and second, by providing in the first and third embodiments two apertures 33, 35 in the sheath 24 so that an installer of the sensing edge 10 can place the conductors 42, 44 through either one of the apertures 33, 35, thus making the sensing edge 10 bilateral.

In operation, the electrical conductors or wires 42, 44 are connected to a circuit (not shown) for controlling the actuation of a device 47 and/or for controlling the operation of the door 12 in response to the application of force to the sheath 24. Specifically, upon the application of force to the exterior surface of the sheath 24, a portion of at least one of the first and second sheets of flexible, electrically conductive material 48, 54 deflects into at least one of the openings 52 in the layer of nonconductive material 50 and makes electrical contact between the first and second sheets of flexible, electrically conductive material 48, 54 to thereby complete or enable the circuit to actuate the device and/or control the operation of the door 12.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A sensing edge for actuating a device to cause a closing door to stop closing upon a force being applied to the sensing edge, the door having a leading edge surface, a first lateral side surface and a second lateral side surface, the first and second lateral side surfaces being oppositely disposed, the sensing edge comprising:

an elongate sheath positioned adjacent to the leading edge surface of the door, and being compressible upon application of an external force, the sheath forming a cavity, the sheath having a front side and a back side and first and second oppositely disposed end openings, the front side and back side having respective front side and back side apertures extending therethrough;

a sensor positioned within the cavity, the sensor being responsive to an external force applied to the sheath substantially between the first and second openings;

a plug fabricated of one piece positioned within the cavity proximate to the first end opening of the sheath, the plug having a first surface facing the cavity, second and third surfaces and facing respectively the front and back sides of the sheath and a fourth surface facing the first end opening, the plug having a channel structure extending from the first surface through the plug to the second and third surfaces; and at least one electrical conductor in electrical communication with the sensor for connection with a circuit for controlling actuation of the door when the sensor detects application of force to the sheath, the conductor extending through the channel structure from the first surface to one of the second and third surfaces.

2. The sensing edge as recited in claim 1 wherein the channel structure comprises a first, second and third channels extending from the first, second and third surfaces into the plug, respectively, the first channel being in communication with the second and third channels.

3. The sensing edge as recited in claim 2 wherein a fourth channel extends from the fourth surface of the plug to the first channel.

4. The sensing edge as recited in claim 3 wherein the second and third channels are aligned, respectively, with the front side and back side apertures of the sheath when the plug is positioned within the cavity.

5. The sensing edge as recited in claim 4 wherein the conductor extends through the first and fourth channels whereby the conductor may be routed through one of the second and third channels therefore allowing the plug to be positioned proximate either of the first and second side surfaces of the door such that the sensing edge is bilateral.

6. The sensing edge as recited in claim 5 wherein the fourth channel has a cross sectional area which permits the conductor to be recessed below the fourth surface.

7. The sensing edge as recited in claim 1 wherein the end openings of the sheath are generally coplanar with the first and second side surfaces of the door when the sheath is positioned adjacent the leading edge surface of the door.

8. The sensing edge as recited in claim 1 wherein the plug is made of a substantially non-compressible material, the plug, in combination with a stopping block positioned proximate to the second end of the sheath preventing the sensor from detecting an external force to the sheath when the sensing edge makes contact with only an intended surface.

9. The sensing edge as recited in claim 1 wherein the plug is sealed to the sheath.

10. A sensing edge for actuating a device to cause a closing door to stop closing upon a force being applied to the sensing edge, the door having a leading edge surface, a first lateral side surface and a second lateral side surface, the first and second lateral side surfaces being oppositely disposed, the sensing edge comprising:

an elongate sheath positioned adjacent to the leading edge surface of the door and being compressible upon application of an external force, the sheath forming a cavity, the sheath having a front side and a back side and first and second oppositely disposed end openings;

a sensor positioned within the cavity, the sensor being responsive to an external force applied to the sheath substantially between the first and second openings;

at least one electrical conductor in electrical communication with the sensor for connection with a circuit for controlling actuation of the door when the sensor detects application of force to the sheath; and a plug positioned within the cavity proximate to the first end opening of the sheath, the plug having a first surface facing the cavity, second and third surfaces facing respectively the front and back sides of the sheath and a fourth surface facing the first opening, the conductor being at least integrally molded within and exiting from the plug at the first surface and at least one of the second, third and fourth surfaces of the plug.

11. The sensing edge as recited in claim 10 wherein the molded conductor extends from the first surface of the plug to one of the second, third and fourth surfaces of the plug.

12. The sensing edge as recited in claim 11 wherein the plug further comprises at least second and third channels extending from the second and third surfaces into the plug, the conductor extending through one of the second and third channels without being molded to the one second and third channel therefore allowing the plug to be positioned proximate either of the first and second side surfaces of the door such that the sensing edge is bilateral.

13. The sensing edge as recited in claim 12 wherein the front side and back side of the sheath have respective front side and back side apertures extending therethrough, the second and third channels of the plug being aligned, respectively, with the front side and back side apertures of the sheath when the plug is positioned within the cavity.

14. The sensing edge as recited in claim 13 wherein the fourth face of the plug has a fourth channel, the conductor being recessed within the fourth channel when the conductor is routed through one of the second and third channels.

15. The sensing edge as recited in claim 10 wherein the end openings of the sheath are generally coplanar with the first and second side surfaces of the door when the sheath is positioned adjacent the leading edge surface of the door.

16. The sensing edge as recited in claim 10 wherein the plug is made of a substantially non-compressible material, the plug, in combination with the stopping block positioned proximate to the second end of the sheath preventing the sensor from detecting an external force to the sheath when the sensing edge makes contact with only an intended surface.

17. The sensing edge as recited in claim 10 wherein the plug is sealed to the sheathing.

18. A sensing edge for actuating a device to cause a closing door to stop closing upon a force being applied to the sensing edge, the door having a leading edge surface, a first lateral side surface and a second lateral side surface, the first and second lateral side surfaces being oppositely disposed, the sensing edge comprising:

an elongate sheath positioned adjacent to the leading edge surface of the door, and being compressible upon application of an external force, the sheath forming a cavity, the sheath having a front side and a back side and first and second oppositely disposed end openings, the front side and back side having respective front side and back side apertures extending therethrough;

a sensor positioned within the cavity, the sensor being responsive to an external force applied to the sheath substantially between the first and second openings;

a plug positioned within the cavity proximate to one of the first end and second end openings of the sheath, the plug having a first surface facing the cavity, second and third surfaces facing respectively the front and back sides of the sheath and a fourth surface facing the first end opening, the plug having a channel structure comprising first, second, third and fourth channels extending respectively from the first, second, third and fourth surfaces into the interior of the plug, the fourth channel being in communication with the first, second and third channels; and at least one electrical conductor in electrical communication with the sensor for connection with a circuit for controlling actuation of the door when the sensor detects application of force to the sheath, the conductor extending through the first and the fourth channels whereby the conductor may be thereafter routed through one of the second and third channels thereby allowing the plug to be positioned proximate either of the first and second side surfaces of the door such that the sensing edge is bilateral.

* * * * *